US006725693B2

(12) United States Patent
Yu et al.

(10) Patent No.: US 6,725,693 B2
(45) Date of Patent: Apr. 27, 2004

(54) DOOR LOCK WITH A CLUTCH HAVING A CAM-STYLED AXLE SLEEVE

(76) Inventors: Jer Ming Yu, 13 Fl.-3, No. 266, Sec. 1, Wenhua 2nd Rd., Linkou Shiang, Taipei (TW); Chen-Chien Chen, No. 2, Lane 476, Huacheng Rd., Shinjuang City, Taipei (TW); Chao-Ming Cheng, No. 17, Lane 410, Julin Rd., Linkou Shiang, Taipei (TW)

( * ) Notice: Subject to any disclaimer, the term of this patent is extended or adjusted under 35 U.S.C. 154(b) by 26 days.

(21) Appl. No.: 10/230,994

(22) Filed: Aug. 30, 2002

(65) Prior Publication Data

US 2004/0040352 A1 Mar. 4, 2004

(51) Int. Cl.[7] ..... E05B 47/06

(52) U.S. Cl. ..... 70/107; 70/277; 70/472; 70/223; 292/336.3; 292/144

(58) Field of Search ..... 70/107, 217, 218, 70/221, 223, 224, 472, 277–283.1; 292/336.3, 144

(56) References Cited

U.S. PATENT DOCUMENTS 1,387,888 A * 8/1921 Holt ..... 292/DIG. 27 X
1,968,285 A * 7/1934 Egan ..... 70/149 X
3,922,896 A * 12/1975 Kagoura ..... 70/223
4,073,527 A * 2/1978 Schlage ..... 292/144 X
4,108,482 A * 8/1978 Dietrich et al. ..... 70/472 X
4,148,092 A * 4/1979 Martin ..... 70/149 X
4,177,657 A * 12/1979 Aydin ..... 70/278
4,276,760 A * 7/1981 Nolin ..... 70/107
4,671,087 A * 6/1987 Olenfalk et al. ..... 70/283
4,820,330 A * 4/1989 Lin ..... 70/277
4,843,851 A * 7/1989 Frolov ..... 70/277
4,995,248 A * 2/1991 Liu ..... 70/107
5,010,752 A * 4/1991 Lin ..... 70/277
5,027,629 A * 7/1991 Liu ..... 70/277
5,040,391 A * 8/1991 Lin ..... 70/277
5,044,184 A * 9/1991 Herbers et al. ..... 70/277
5,544,507 A * 8/1996 Lin ..... 70/107
5,577,583 A * 11/1996 O'Donnell ..... 292/336.3 X
5,715,715 A * 2/1998 Nunez ..... 70/283
5,884,515 A * 3/1999 Milman ..... 70/472
5,946,955 A * 9/1999 Suggs et al. ..... 70/218
6,032,991 A * 3/2000 Yeh ..... 292/336.3
6,062,612 A * 5/2000 Lin ..... 292/336.3 X
6,145,353 A * 11/2000 Doucet ..... 70/277
6,334,636 B1 * 1/2002 Huang et al. ..... 292/144

* cited by examiner

*Primary Examiner*—Suzanne Dino Barrett
(74) *Attorney, Agent, or Firm*—Troxell Law Office PLLC

(57) ABSTRACT

The door lock with a clutch having a cam-styled axle sleeve comprises mainly of an outer lock part and an inner lock part, both the housings of the outer and the inner lock parts are provided with a handle to rotate the internal rotation axle thereof. The rotation axle of the outer lock part is provided thereon with the cam-styled axle sleeve; the rotation axle of the inner lock part is further connected with a second rotation axle. The axle sleeve of the outer lock part is controlled for positioning and moving by a control device. When the axle sleeve is positioned, the rotation axle of the outer lock part and the second rotation axle of the inner one are separated. Therefore, a dead bolt and a latch bolt protruding out of the door are not influenced by the rotation of the handle of the outer lock part; when the axle sleeve is moved forwards, the second rotation axle of the inner lock is integrally connected with the axle sleeve to control extending/contracting of the dead bolt and the latch bolt on the door.

10 Claims, 11 Drawing Sheets

DOOR LOCK WITH A CLUTCH HAVING A CAM-STYLED AXLE SLEEVE

BACKGROUND OF THE INVENTION

1. Field of the Invention

The present invention is related to a door lock with a clutch having a cam-styled axle sleeve, and especially to providing a cam-styled axle sleeve on a rotation axle of an outer lock part. By controlling whether the cam-styled axle sleeve is connected with a rotation axle of an inner lock part with a control device, the effect of opening and closing of the door lock is controlled, which particularly suits the lock structures of a gate, a room door etc.

2. Description of the Prior Art

Conventional lock structures are mainly mounted on door panels with an inner and an outer side, such a door lock is generally comprised of a dead bolt, two fixing seats, a restoring mechanism with a torsional spring in a receiving chamber, a restoration mechanism to move back a linking-up column by means of a torsion spring, a connecting mechanism to fix the two fixing seats on the door panel, and two handles respectively on the two fixing seats to be linked up with a control rod. Such a door lock structure needs multiple operating steps to open the lock indoors, and will delay the time for fleeing from danger; thereby it is not an ideal device.

The inventor of the present invention develops a novel door lock with a clutch having a cam-styled axle sleeve, which can be easily opened indoors, and can be opened outdoors electrically or manually.

SUMMARY OF THE INVENTION

The main object of the present invention is to provide a door lock with a clutch having a cam-styled axle sleeve. By controlling the cam-styled axle sleeve through an outer lock part provided with a control device, the cam-styled axle sleeve moves forwards to connect with a second rotation axle of an inner lock part to control opening and closing of the door lock.

The secondary object of the present invention is to provide a door lock with a clutch having a cam-styled axle sleeve, wherein through the inner lock part, the door can be opened indoors any time by directly pressing down the inner handle on the door, especially favor fleeing from danger in an emergency.

To achieve the objects stated above, the present invention is comprised mainly of an inner lock part and an outer lock part integrated with each other, and are further combined with a dead bolt and a telescopic spring-loaded latch bolt mounted on a lateral side of a door panel. The outer lock part is mounted on the outer side of a door panel, and the inner lock part on the inner side; both the housings of the inner and the outer lock parts are provided with a handle to drive the internal rotation axle thereof. The rotation axle of the outer lock part is provided thereon with a cam-styled axle sleeve which is controlled for forwarding or positioning by another element of the outer lock part—a control device; the rotation axle of the inner lock part can drive an inner pull rod, where the remote end connects another axle of the inner lock part and is linked up with the dead bolt. The front end of the rotation axle of the inner lock part is further connected with a second rotation axle in addition to being linked up with the latch bolt. The second rotation axle can be telescopically connected with the cam-styled axle sleeve of the rotation axle of the outer lock part to make integration of the rotation axle of the outer lock part with the rotation axle of the inner lock part. By rotation of the handles to control extending and contracting of the dead bolt and the latch bolt on the door; the door is opened by pressing down the handle of the inner lock part or the outer lock part. When the cam-styled axle sleeve of the outer lock part is controlled and positioned by the control device, the rotation axle of the outer lock part and that of the inner lock part are separated, therefore the dead bolt and the latch bolt on the door are not influenced by the revolving direction or prizing of the handle of the outer lock part. By virtue that the rotation axle of the inner lock part can be linked up with the dead bolt and the latch bolt, so that in any state, rotation of the handle of the inner lock part can control extending and contracting of the dead bolt and the latch bolt on the door. And the control device can allow the lock to control displacement of the cam-styled axle sleeve of the outer lock part manually, or automatically by providing with an electric circuit board, a motor and a gear etc. to cooperate with an externally connected card reader, a code reader, a remote control etc. to open the lock in a more convenient and safer way.

The present invention will be apparent in its features and specific structure after reading the detailed description of the preferred embodiment thereof in reference to the accompanying drawings.

DETAILED DESCRIPTION OF THE PREFERRED EMBODIMENT

Figure 1:
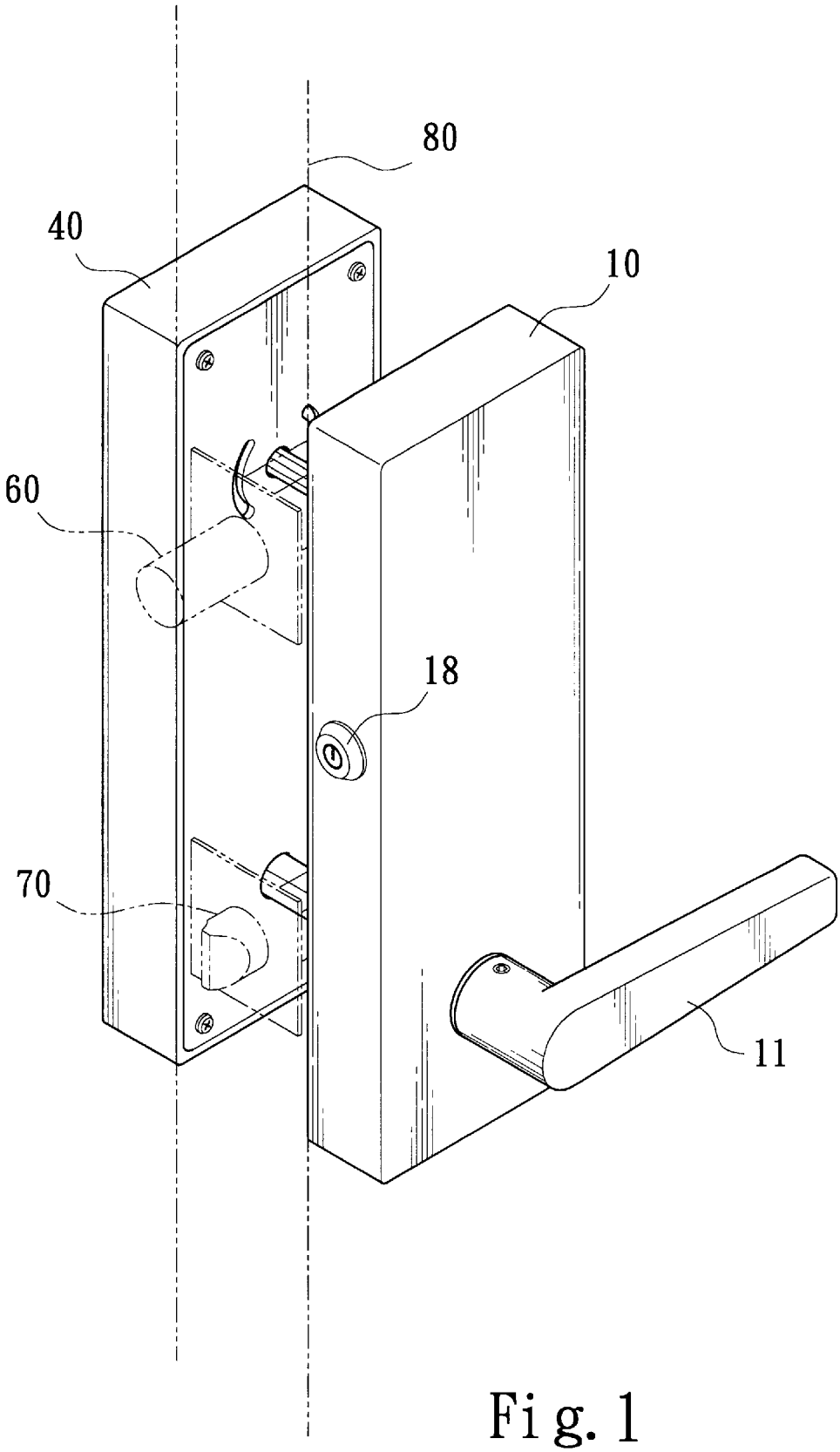
FIG. 1 is a perspective view of an embodiment of the present invention connecting with a door panel.

Referring to FIG. 1, the door lock with a clutch having a cam-styled axle sleeve of the present invention is comprised of an outer lock part 10, an inner lock part 40, a dead bolt 60 and a spring-loaded latch bolt 70 mounted together on a door panel 80.

Figure 2:
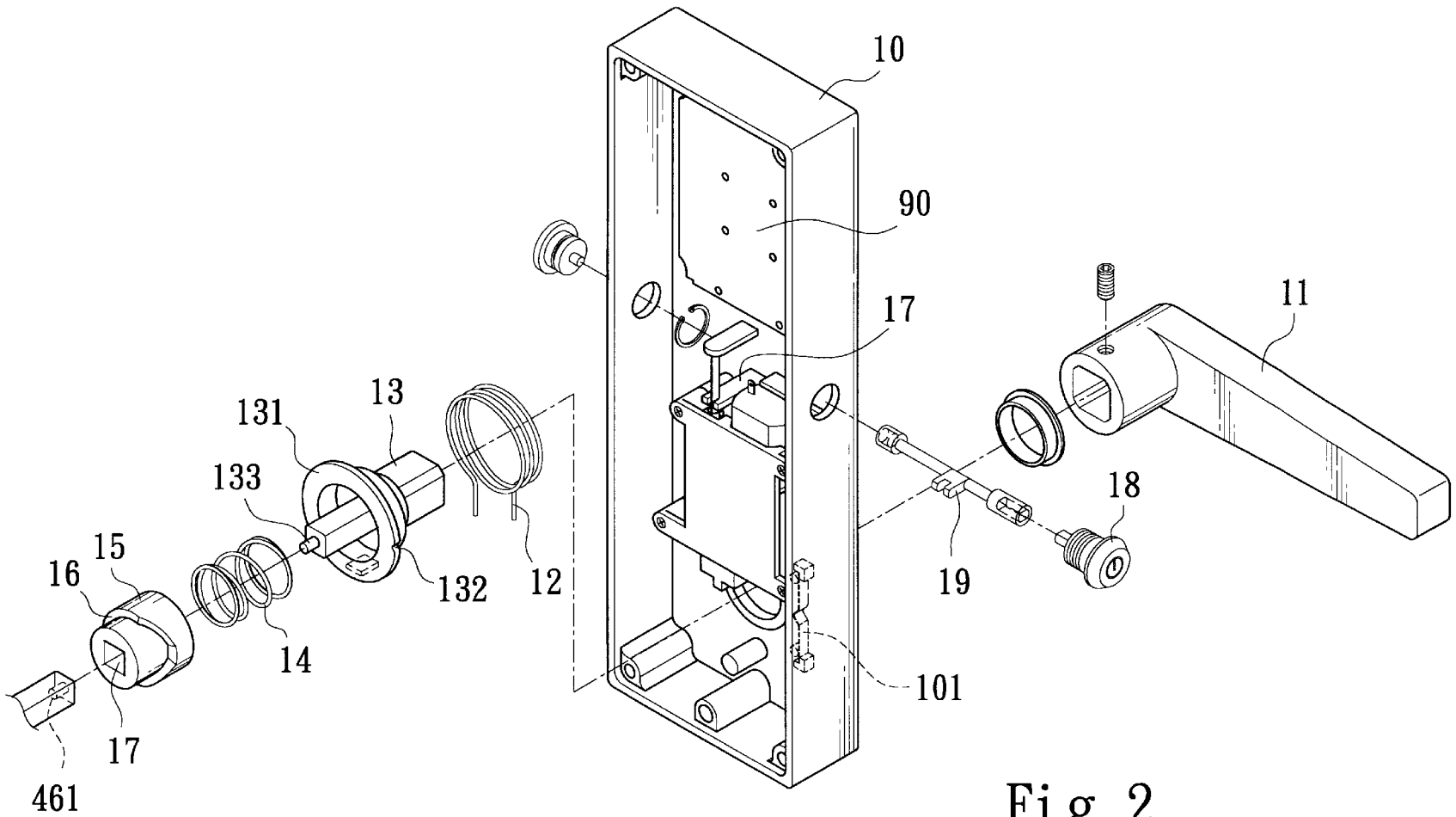
FIG. 2 is an analytic perspective view showing the elements of an outer lock part of the embodiment of the present invention.

Wherein: referring to FIG. 2, the outer lock part 10 is a housing with a suitable size, and is provided at suitable locations therein with screw studs and protruding blocks for screwing connecting and positioning of the remaining members. The outer lock part 10 is provided on the housing surface thereof with a handle 11 for rotating an outer rotation axle 13; when the rotation axle 13 is connected with the handle 11, a spring 12 is provided between them for restoration of the handle 11. The front and the rear portions of the rotation axle 13 are square stubs with different perimeters; a pot-like member 131 flares out from the step like surface between the front and the rear portions; the pot-like member 131 is provided thereon with a positioning notch 132; the front square stub with a smaller perimeter is provided on the end face thereof with a protruding post 133; a spring 14 and a cam-styled axle sleeve 15 are slipped over the front square stub. The axle hole 17 of the cam-styled axle sleeve 15 is a through hole; the cam-styled axle sleeve 15 is provided at the middle section thereof externally with an engaging edge 16 to be engaged and controlled by a control device 20 provided above the rotation axle 13.

Figure 3:
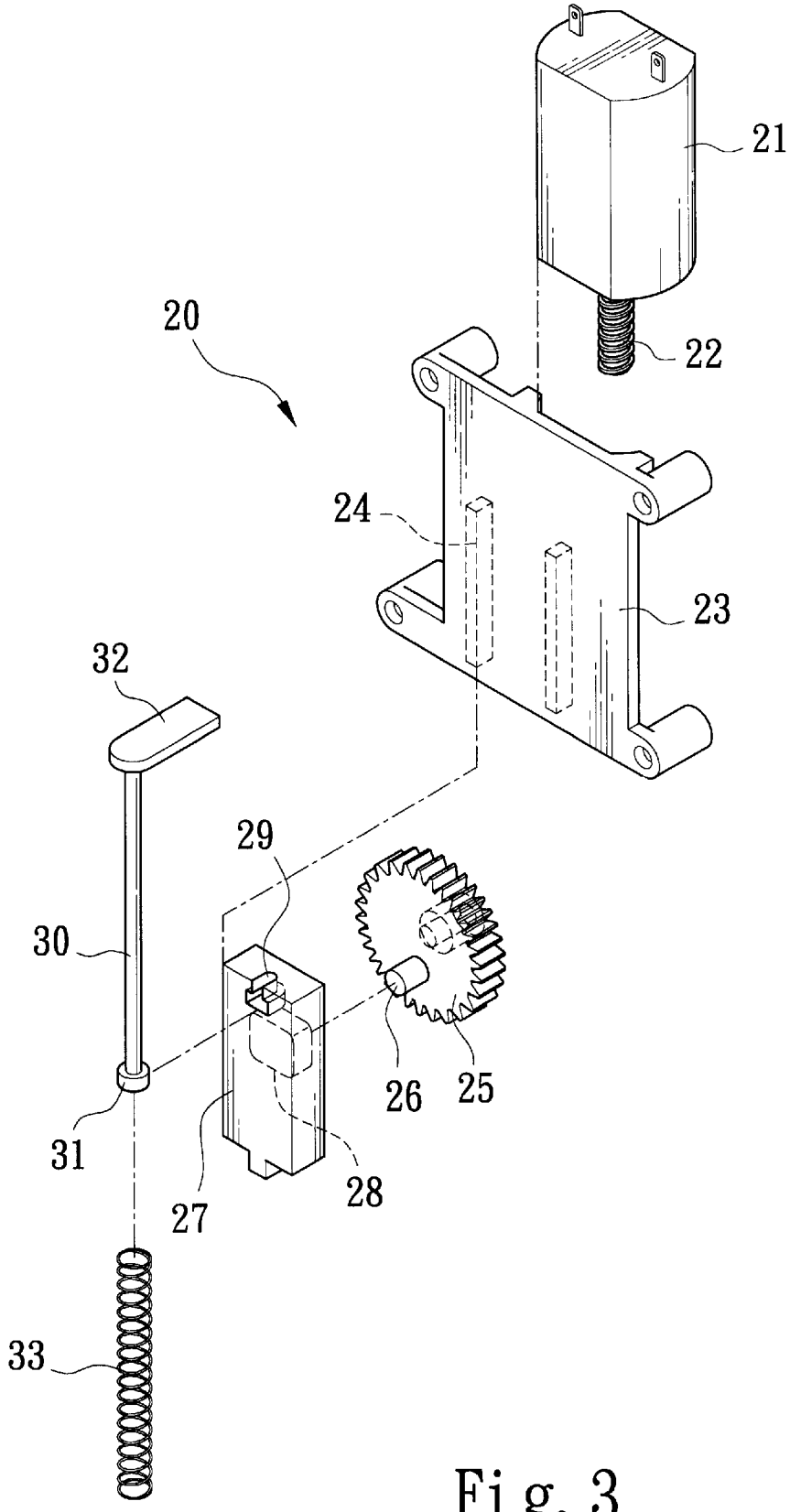
FIG. 3 is an analytic perspective view showing the elements of a control device of the embodiment of the present invention.

The control device 20 (referring to FIG. 3) is comprised of: a motor 21, a gear 25, an abutting block 27, a pull rod 30 and a lid 23. Wherein the axle of the motor 21 is in the form of a screw rod 22 to be engaged with the gear 25; the gear 25 is provided on one side thereof with a recess for positioning a protruding block provided on the housing and is provided on the other side with an eccentric protruding block 26 for placing in a recess 28 on the abutting block 27. The abutting block 27 is provided on the top thereof with a positioning groove 29 for positioning of the pull rod 30 (on the abutting block 27) having on one end thereof a sheet 32, on the other end thereof a positioning block 31 and being slipped thereover by a spring 33. And the lid 23 with a pair of positioning bars 24 is locked in the housing. The abutting block 27 is exactly abutted on the engaging edge 16 of the cam-styled axle sleeve 15. And referring to FIG. 2, the pull rod 30 extending out of the lid 23 is engaged with a protruding member 19 provided on a lock core rod of a locking member 18, a circuit board 90 is added to receive the electronic signal s to control rotation of the motor 21.

Figure 4:
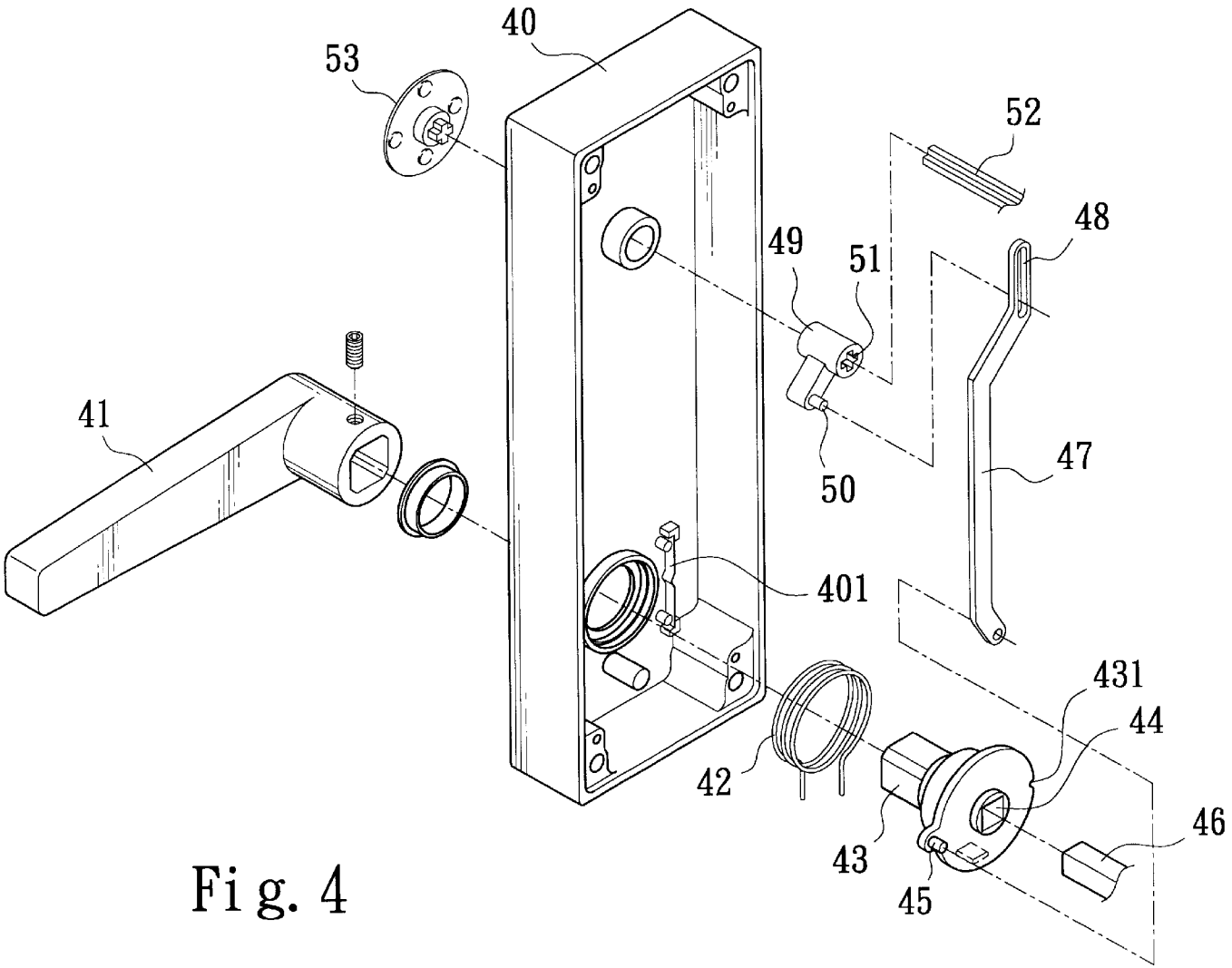
FIG. 4 is an analytic perspective view showing the elements of an inner lock part of the embodiment of the present invention.

As shown in FIG. 4, the inner lock part 40 has a size in coincidence with that of the housing of the outer lock part 10, the housing is provided at locations therein with screw studs and protruding blocks for screwing connecting and positioning of the remaining members. The inner lock part 40 is provided on the housing surface thereof with a handle 41 for rotating an inner rotation axle 43; when the rotation axle 43 is connected with the handle 41, a spring 42 is provided between them for restoration of the handle 41. The front and the rear portions of the rotation axle 43 are in different shapes, the front portion in connecting with the handle 41 is a square stub; while the rear portion is a round member which is provided in the center thereof with a recessed axle hole 44, the axle hole 44 is inserted therein with a second rotation axle 46 which is provided on one end thereof with a recess 461 (as shown in FIG. 2). The round member on the rear portion of the rotation axle 43 is provided laterally with a protruding post 45 able to move an inner pull rod 47 which is provided on the other end thereof with an elongate slot 48. The elongate slot 48 is to be slipped over a protruding post 50 provided on an axle seat 49; the axle seat 49 is provided thereon with a cross hole 51 which is provided on the inner end thereof with a cross mandrel 52, and is further provided on the outer end thereof with an indicating disk 53.

Figure 5:
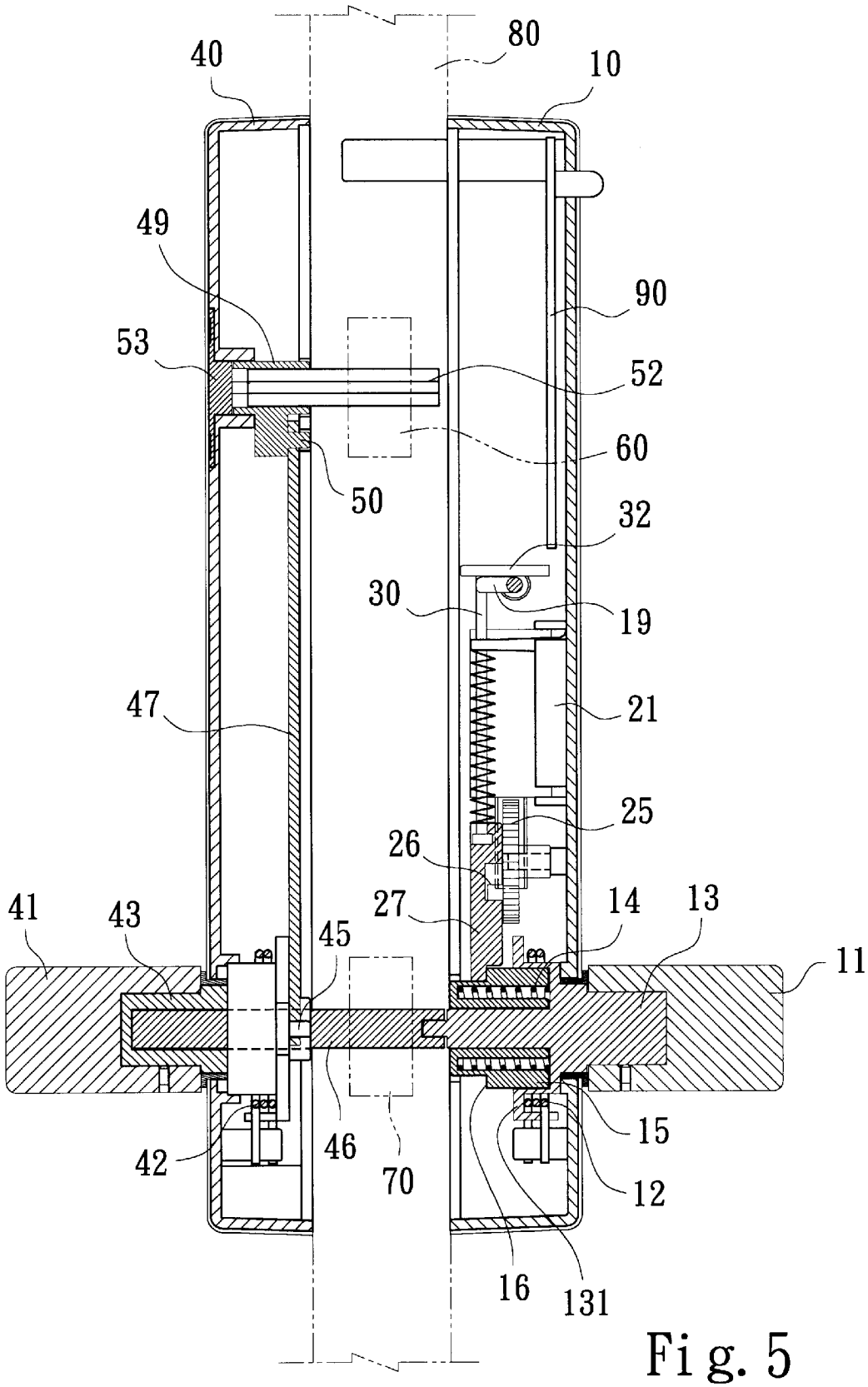
FIG. 5 is a sectional view of the embodiment of the present invention after assembling.
Figure 5A:
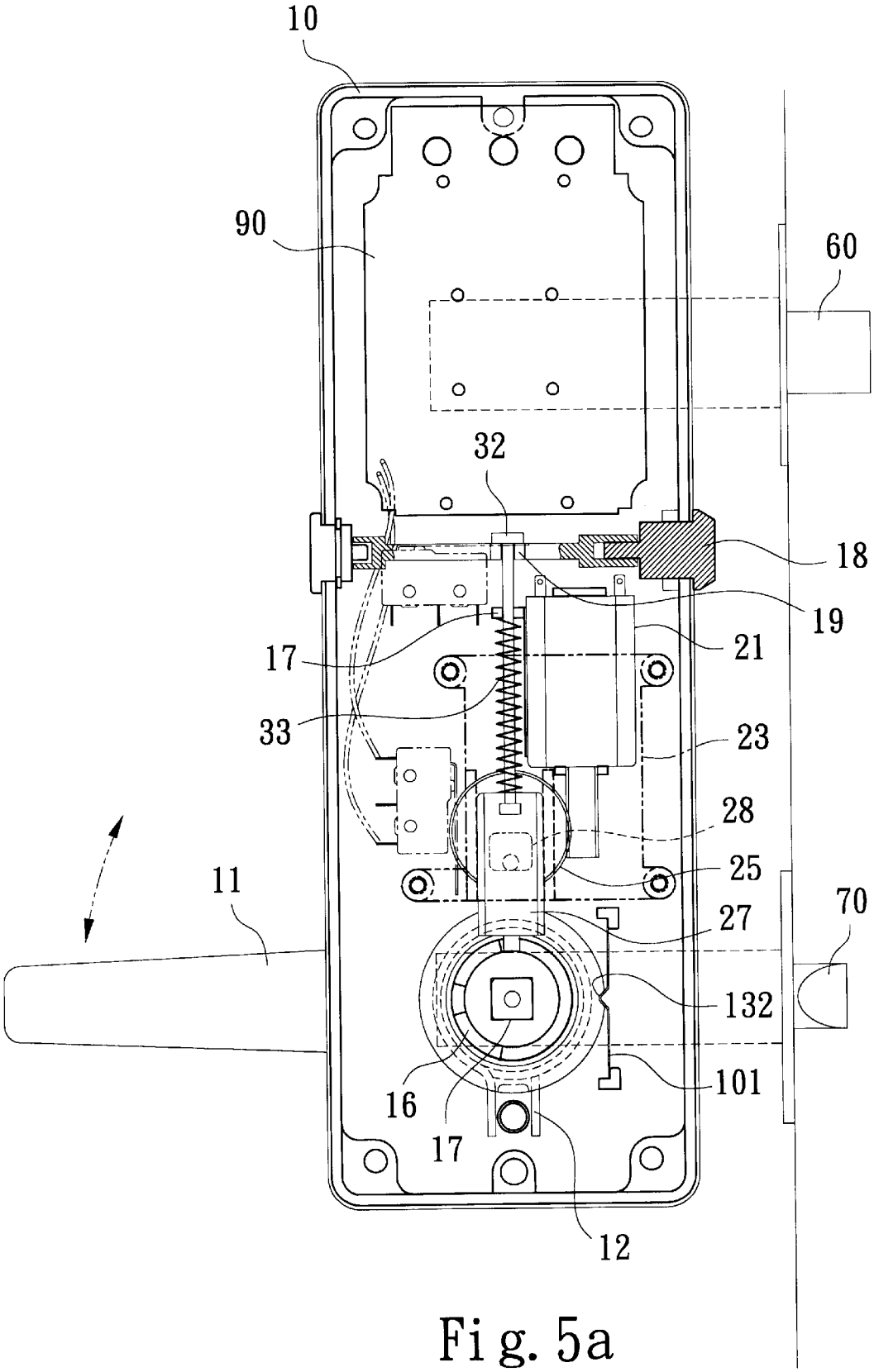
FIG. 5*a* is a schematic sectional view showing invalidation of operation of the outer lock part of the present invention.
Figure 5C:
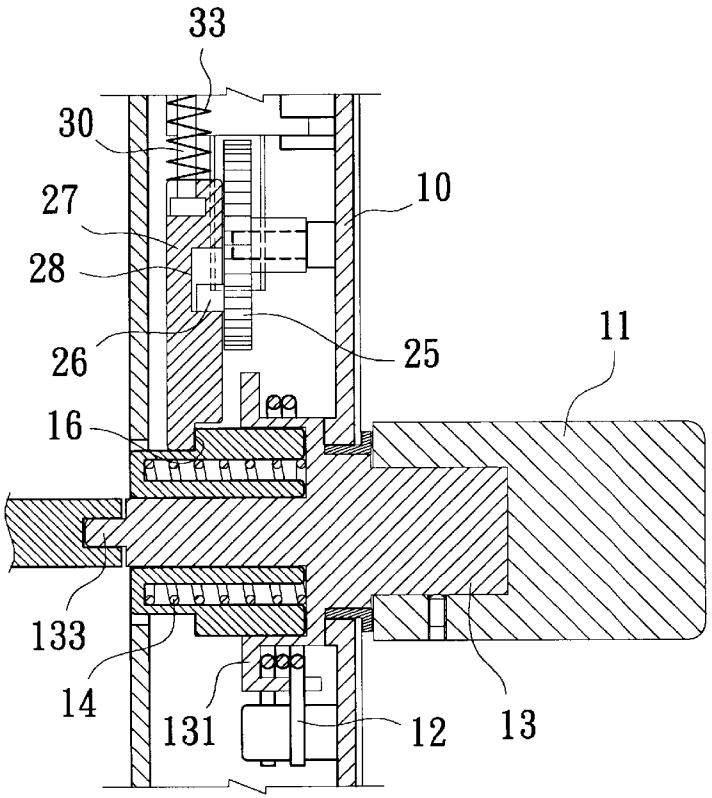
FIG. 5*c* is a schematic sectional side view of the outer lock part of the present invention.
Figure 5B:
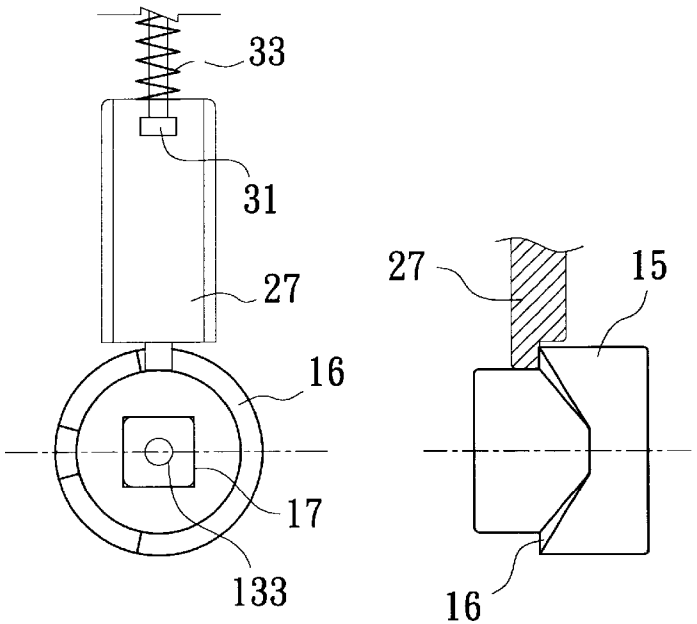
FIG. 5*b* is a partially enlarged schematic view of the outer lock part of the present invention.

The dead bolt 60 and the spring-loaded latch bolt 70 is mounted together on the door panel 80 when the present invention is connected with the door panel 80, as shown in FIG. 5. The inner lock part 40 is mounted inside the door panel 80, while the outer lock part 10 is mounted outside the door panel 80 opposite to the inner lock part 40. The recess 461 on the end of the second rotation axle 46 linked up with the handle 41 of the inner lock part 40 is connected with the protruding post 133 on the end face of the rotation axle 13 linked up with the handle 11 of the outer lock part 10, and the dead bolt 60 and the spring-loaded latch bolt 70 are both linked up with the inner lock part 40; the dead bolt 60 is controlled by the cross mandrel 52, while the spring-loaded latch bolt 70 is controlled by the second rotation axle 46; the cross mandrel 52 is linked up with the rotation axle 43 through the inner pull rod 47 and thereby is synchroncially controlled by the handle 41. Referring simultaneously to FIGS. 5*a*, 5*b*, and 5*c*, when the dead bolt 60 and the spring-loaded latch bolt 70 are connected with each other, the abutting block 27 of the control device 20 tightly abuts against the engaging edge 16 of the cam-styled axle sleeve 25 to position the cam-styled axle sleeve 15 against moving. Meanwhile, although the protruding post 133 of the rotation axle 13 is connected with the recess 461 on the end of the second rotation axle 46, it is unable to move the second rotation axle 46. Consequently, no matter clockwise or counterclockwise the handle 11 only swivels the rotation axle 13 but does not move the second rotation axle 46, and thereby the door panel 80 is unable to open.

Figure 6:
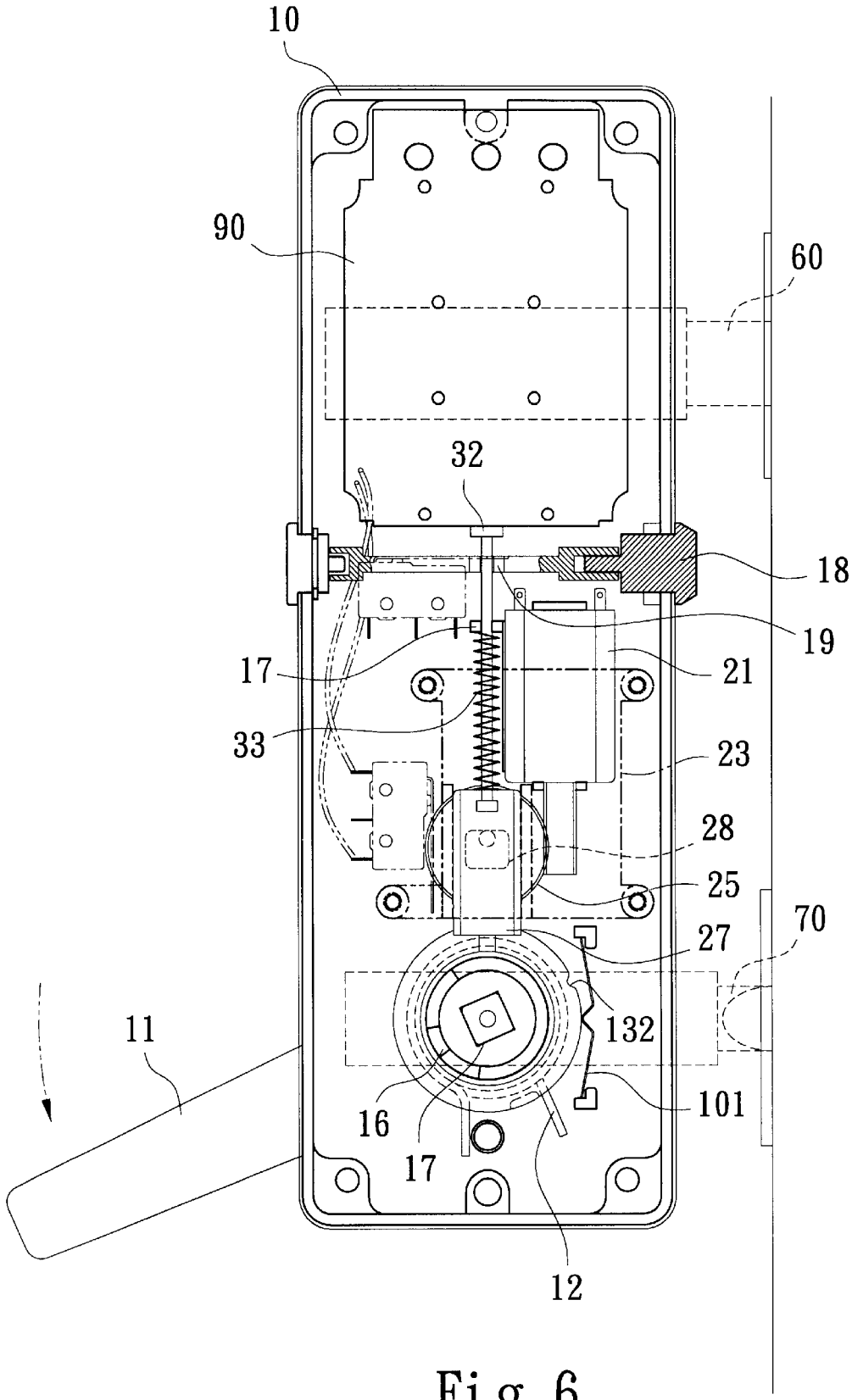
FIG. 6 is a schematic sectional view showing effectiveness of operation of the outer lock part of the present invention.
Figure 6B:
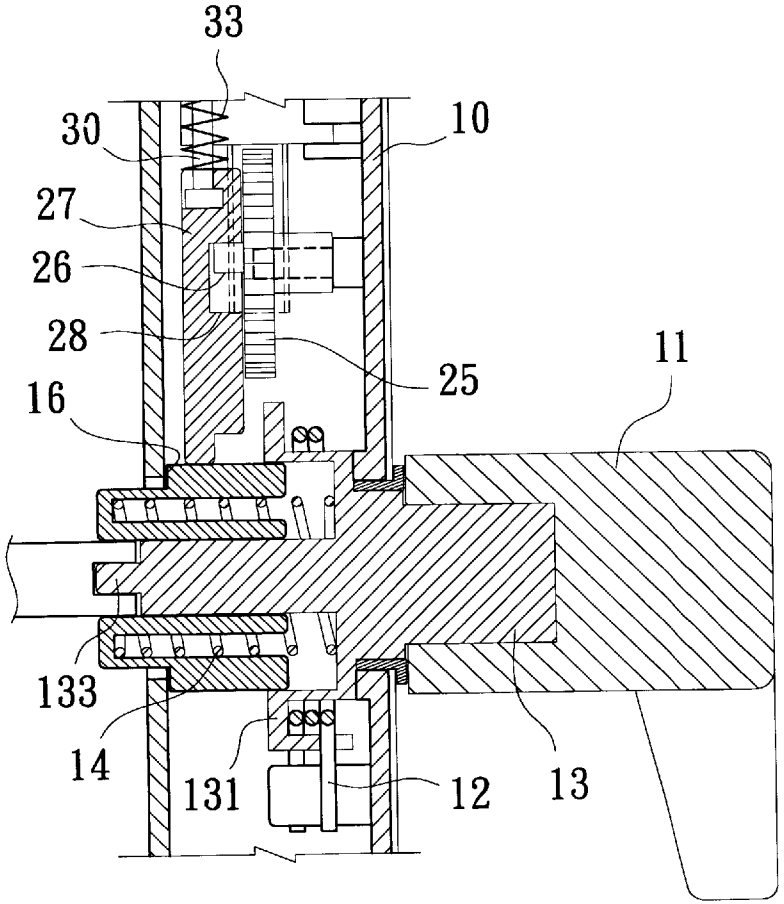
FIG. 6*b* is a schematic sectional side view of the outer lock part of the present invention.
Figure 6A:
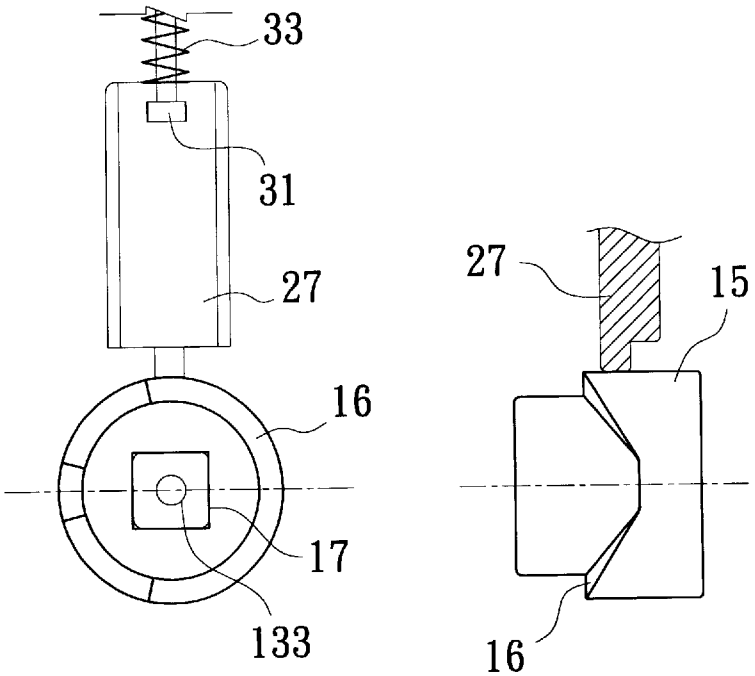
FIG. 6*a* is a partially enlarged schematic view of the outer lock part of the present invention.

Referring simultaneously to FIGS. 6 6*a*, and 6*b*, the locking member 18 can be a conventional lock with a lock hole for inserting therein of a key, the lock core rod connected on the rear end of the locking member 18 is provided in the middle thereof with the protruding member 19; when the key is rotated in the lock hole, the protruding member 19 of the lock core rod is rotated to move the pull rod 30 and move up the abutting block 27 to move forwards the cam-styled axle sleeve 15; the square axle hole 17 of the cam-styled axle sleeve 15 is slipped over the second rotation axle 46 to make the rotation axle 13 of the outer lock part 10 and the rotation axle 43 of the inner lock part 40 as an integral whole. When the handle 11 is pressed down, the rotation axle 13, the cam-styled axle sleeve 15, the second rotation axle 46, and the rotation axle 43 are swiveled synchronically. The spring-loaded latch bolt 70 is moved by the second rotation axle 46, and the protruding post 45 of the rotation axle 43 is linked up to move the inner pull rod 47. So that the protruding post 50 restrained by the elongate slot 48 and the axle seat 49 linked up with the protruding post 50 are synchronically rotated therewith,. The cross mandrel 52 inserted in the cross hole 51 is linked up with the dead bolt 60 which is contracted together with the spring-loaded latch bolt 70 into the door panel 80 to allow easy opening of the door panel 80. And the indicating disk 53 provided exteriorly of the inner lock part 40 and slipped over the cross hole 51 is rotated too, thereby, a person can be aware by visual viewing of the state of opening/closing.

The outer lock part 10 and the inner lock part 40 are provided with spring leaves 101, 401, and the rotation axles 13, 43 linked up with the handles 11, 41 are provided on the exterior peripheries respectively thereof with positioning notches 132, 431. By virtue that the springs 12, 42 are respectively provided between the rotation axles 13, 43 and the handles 11, 41, the rotation axles 13, 43 will be rebounded respectively by the springs 12, 42 and are positioned respectively by the positioning notches 132, 431 and the spring leaves 101, 401 to restore the handles 11, 41 to their original positions.

Figure 7:
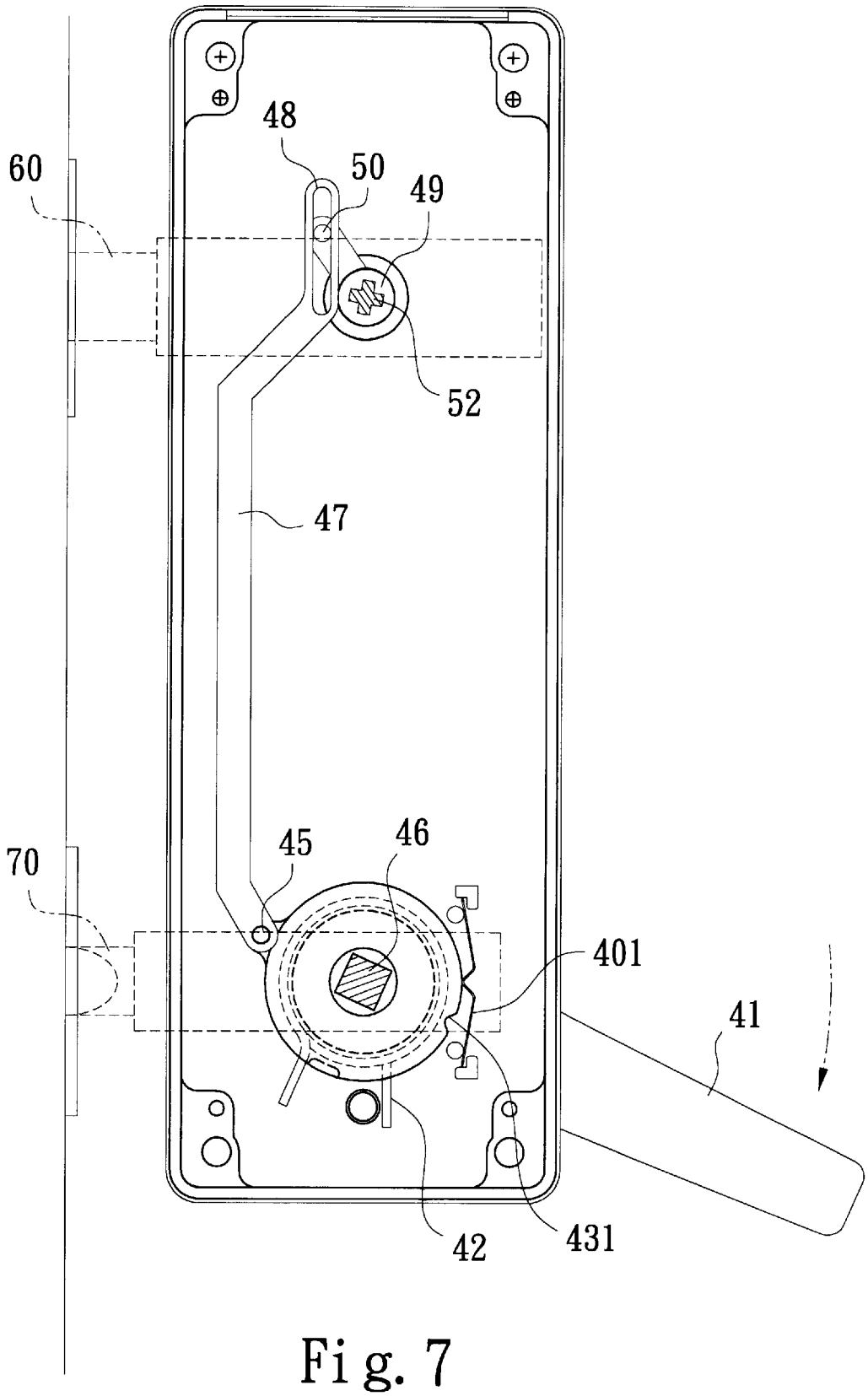
FIG. 7 is a schematic view showing opening of the door in using the inner lock part of the present invention.

Referring to FIG. 7, going outdoors needs only to press down the handle 41. Because the dead bolt 60 and the spring-loaded latch bolt 70 on the door panel 80 are directly controlled by the second rotation axle 46 and the cross mandrel 52 respectively, and these two are synchronically linked up by the rotation axle 43, the door panel 80 can be opened by pressing down the handle 41. In any emergency situation such as conflagration or earthquake the door panel 80 can be opened easily as described above.

Figure 8:
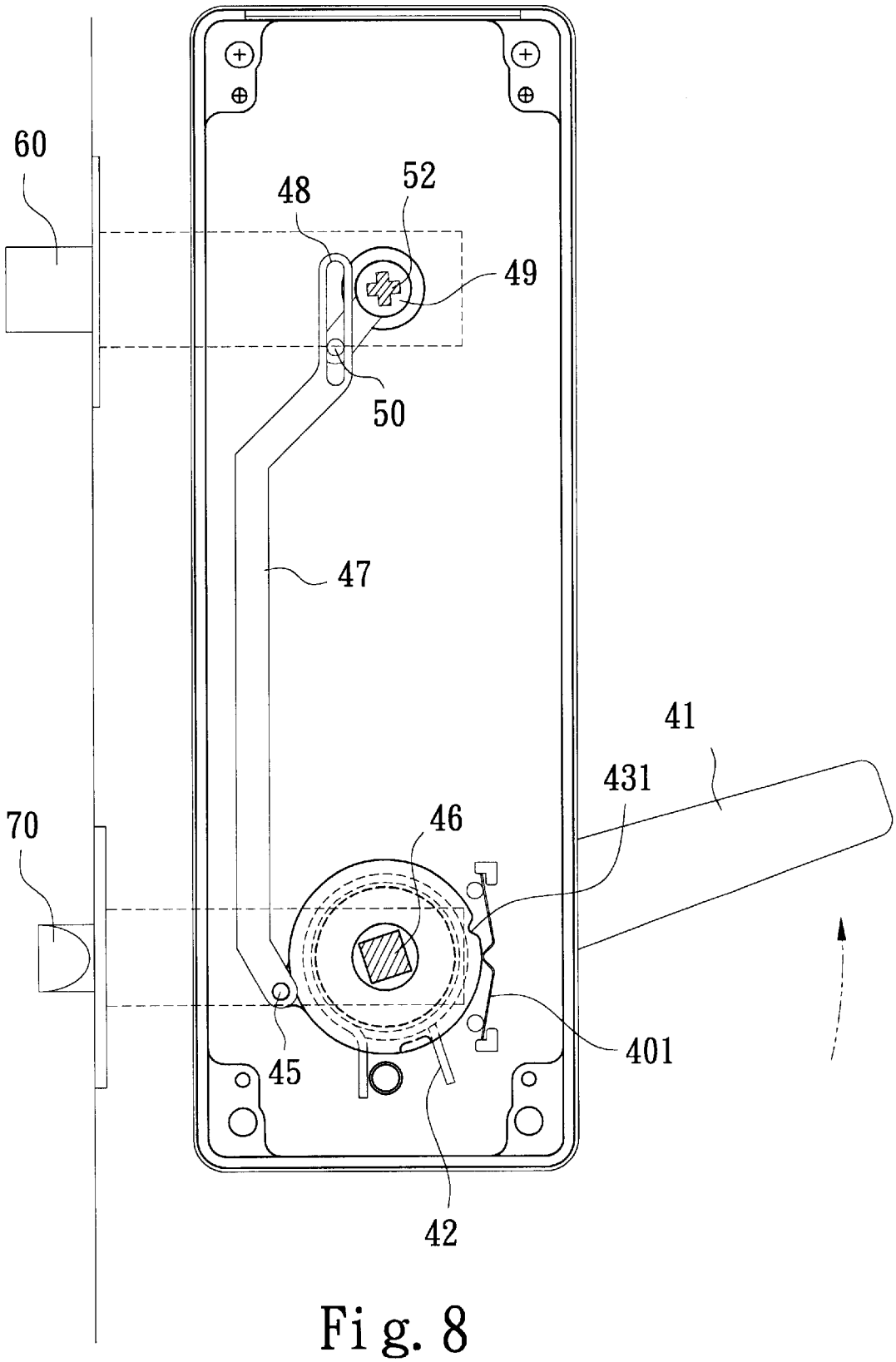
FIG. 8 is a schematic view showing closing of the door in using the inner lock part of the present invention.

To lock the door panel 80 from the outdoors, the locking member 18 is inserted with a key for turning, and the protruding member 19 of the lock core rod is rotated to move the abutting block 27, and further move forwards the cam-styled axle sleeve 15 to make integral of the rotation axle 13 with the second rotation axle 46; then the handle 11 is pulled to swivel to make reversion of the rotation axle 13, the cam-styled axle sleeve 15, the second rotation axle 46 and the rotation axle 43 so that the dead bolt 60 can be extended out of the door panel 80 and lock the latter. To lock the door panel 80 from the indoors, it needs only to pull up the handle 41, such as is shown in FIG. 8, to make reversion of the rotation axle 43 to move the second rotation axle 46 and the cross mandrel 52 to thereby extend the dead bolt 60 out of the door panel 80.

The control device 20 of the present invention not only can render the locking member 18 to control raising and lowering of the abutting block 27 manually, but also can be added with an electric circuit board 90 to automatically control the motor 21 to render the screw rod 22 of the motor 21 to move the gear 25; the eccentric protruding block 26 of the gear 25 can thereby move the abutting block 27, so that the cam-styled axle sleeve 15 can be positioned and moved forwards. There are many ways to control the electric circuit board 90, for example, it can be automatically controlled by an externally connected card reader, code reader or a remote control etc., so that the door can be opened in a more convenient and safer way.

The locking member 18 of the present invention is provided on one side of the outer lock part 10 and is quite close to the door frame; the distance between the outer lock part 10 and the door frame is less than 2 cm; the key for the locking member 18 is in the shape of "L" to provide theft-proofing because it is hard to be pried with a tool or a master key.

The door lock with a clutch having a cam-styled axle sleeve of the present invention has the following advantages:

1. The present invention is provided with a device as a clutch which is composed of a control device and a cam-styled axle sleeve to be able to control integration of rotation axles and in turn to control opening/closing of a door lock practically.
2. The dead bolt and the spring-loaded latch bolt of the present invention are directly or indirectly linked up with the rotation axle of the inner lock part, so that the handle of the inner lock part can be directly pressed down to open the door in any situation, which help opening the door for fleeing in an emergency.
3. The inner lock part is provided with an indicating disk to indicate the state of whether the dead bolt is locked with different colors or signs so it is very convenient in awareness the state.

In conclusion, the door lock with a clutch having a cam-styled axle sleeve of the present invention has a brand-new component arrangement and evidently improved function in relating to the door lock devices used presently.

All modifications and variations to the invention that would be obvious to a person of ordinary skill in the art are deemed to be within the scope of the present invention the nature of which is to be determined from the above description and the appended claims.

What is claimed is:

1. A door lock with a clutch having a cam-styled axle sleeve comprising:

an outer lock part including a housing and a handle, said housing is provided therein with a rotation axle and a control device; said control device includes a motor, a gear, an abutting block and an electric circuit board for controlling operation of said motor; one end of said rotation axle is connected with and linked-up by said handle, while the other end of said rotation axle is provided with a spring and a cam-styled axle sleeve which is provided with a central axle hole extending therethrough, an engaging edge externally thereon to engage with said abutting block of the control device so as to position or move forwards said cam-styled axle sleeve; said rotation axle is provided between two ends thereof with a fixed pot-like member for receiving and abutting on said spring; said electric circuit board receives electronic signals to control rotation of said motor and consequently to drive said gear and to control raising or lowering of said abutting block, so that said cam-styled axle sleeve is under control for positioning and moving forwards;

an inner lock part including a housing on which there is provided a handle outside, and inside a rotation axle, a cross mandrel linked up with a dead bolt, an axle seat engaged with said cross mandrel and an inner pull rod; one end of said rotation axle is connected with and driven by said handle, while the other end of said rotation axle is engaged with a second rotation axle; one end of said inner pull rod is connected with said axle sleeve, and the other end of said inner pull rod is connected with said rotation axle; in connecting with said door panel, said outer lock part is mounted on the outside of said door panel, while said inner lock part is mounted on the inside of said door panel opposite to said outer lock part; while said door panel is mounted laterally with said dead bolt and a telescopic spring-loaded latch bolt, said dead bolt is linked up with said cross mandrel on said axle seat, and said spring-loaded latch bolt is linked up with said second rotation axle; when said handle of said inner lock part is rotated, extending and contracting of said dead bolt and latch bolt are controlled for opening and closing said door lock; when said cam-styled axle sleeve of said outer lock part is moved forwards, said cam-style axle sleeve is telescopically connected with said second rotation axle of said inner lock part, and the door with said door lock is adapted to opening by pressing down said handle of said outer lock part.

2. The door lock with a clutch having a cam-styled axle sleeve according to claim 1 wherein said housing of said outer lock part further includes a locking member, and a lock hole of said locking member is provided on a lateral side of said housing; said lock hole is connected on the rear thereof with a lock core rod having a protruding member; said control device includes a pull rod with a spring and a lid with a pair of positioning bars; one end of said pull rod is engaged with said protruding member of said lock core rod, while the other end thereof is connected with said abutting block; in rotating the lock hole with a key, said protruding member of said lock core rod is driven to pluck said pull rod and in turn said abutting block is moved up, so that said cam-styled axle sleeve is apart from said abutting block and to be moved forwards to telescopically connect with said second rotation axle of said inner lock part.

3. The door lock with a clutch having a cam-styled axle sleeve according to claim 1 wherein said engaging edge of said cam-styled axle sleeve on said rotation axle of said outer lock part is inclined gradually to allow said abutting block to engage said cam-styled axle sleeve for the next time.

4. The door lock with a clutch having a cam-styled axle sleeve according to claim 1 wherein said gear of said control device is provided with an eccentric protruding block, while said abutting block is provided with a recess for engaging with said eccentric protruding block of said gear.

5. The door lock with a clutch having a cam-styled axle sleeve according to claim 2 wherein the end of said pull rod of the control device that is engaged with said protruding member of the lock core rod is provided as a sheet and on the other end thereof is provided with a positioning block; said abutting block is provided on the top thereof with a positioning groove for engaging with of said positioning block of said pull rod.

6. The door lock with a clutch having a cam-styled axle sleeve according to claim 1 wherein between said handles and said rotation axles of the outer lock part and the inner lock part are both provided with a spring for restoration of said handles after the latter are pressed down or pulled up.

7. The door lock with a clutch having a cam-styled axle sleeve according to claim 1 wherein said axle seat of said inner lock part is provided outside thereon with an indicating disk.

8. The door lock with a clutch having a cam-styled axle sleeve according to claim 1 wherein said electric circuit board is externally connected with an automatic opening system such as a card reader, a code reader or a remote control to automatically open said door lock.

9. The door lock with a clutch having a cam-styled axle sleeve according to claim 1 wherein the end of said rotation axle of said inner lock part that is connected with said second rotation axle is provided as a round member wherein the center thereof provided with a recessed axle hole to engage with said second rotation axle, while a cambered surface thereof is provided with a protruding post to link up with said inner pull rod.

10. The door lock with a clutch having a cam-styled axle sleeve according to claim 1 wherein said axle seat is provided beside thereon with a protruding post, the other end of said inner pull rod is provided with an elongate slot to cover said protruding post.

* * * * *